US008459232B2

(12) United States Patent
Borchsenius et al.

(10) Patent No.: US 8,459,232 B2
(45) Date of Patent: Jun. 11, 2013

(54) INJECTION SYSTEM, AND METHOD FOR THE PRODUCTION OF AN INJECTION SYSTEM

(75) Inventors: Fredrik Borchsenius, Donaustauf (DE); Uwe Jung, Wörth a. d. Donau (DE); Grit Krüger, Regensburg (DE); Eberhard Kull, Regensburg (DE); Volker Mohr, Regensburg (DE)

(73) Assignee: Continental Automotive GmbH, Hannover (DE)

( * ) Notice: Subject to any disclaimer, the term of this patent is extended or adjusted under 35 U.S.C. 154(b) by 625 days.

(21) Appl. No.: 12/676,918

(22) PCT Filed: Aug. 4, 2008

(86) PCT No.: PCT/EP2008/060219

§ 371 (c)(1),
(2), (4) Date: Apr. 15, 2010

(87) PCT Pub. No.: WO2009/033887

PCT Pub. Date: Mar. 19, 2009

(65) Prior Publication Data

US 2010/0192911 A1 Aug. 5, 2010

(30) Foreign Application Priority Data

Sep. 6, 2007 (DE) ..... 10 2007 042 466

(51) Int. Cl.
*F02M 59/46* (2006.01)
*F02M 41/16* (2006.01)

(52) U.S. Cl.
USPC ..... 123/467; 239/96

(58) Field of Classification Search
USPC ..... 123/467, 506; 239/88–96
See application file for complete search history.

(56) References Cited

U.S. PATENT DOCUMENTS 5,526,791 A * 6/1996 Timmer et al. ..... 123/467
5,873,526 A * 2/1999 Cooke ..... 239/88
6,092,737 A * 7/2000 Bosch et al. ..... 239/96

(Continued)

FOREIGN PATENT DOCUMENTS

DE 19907544 8/2000
DE 19939453 A1 3/2001

(Continued)

OTHER PUBLICATIONS

International Search Report and Written Opinion for Application No. PCT/EP2008/060219 (13 pages), Nov. 14, 2008.

*Primary Examiner* — Thomas Moulis
(74) *Attorney, Agent, or Firm* — King & Spalding L.L.P.

(57) ABSTRACT

An injection system for injecting fuel has an actuator, a pilot valve with a valve mushroom, and a supply throttle. The control chamber encompasses a control piston, a first discharge throttle, a first sealing edge for forming a first sealing seat along with the valve mushroom, a second sealing edge of a piston chamber with a valve piston, the second sealing edge forming a second sealing seat along with the valve piston during a maximum actuator working lift for sealing the piston chamber and the valve chamber from each other; and a second discharge throttle connecting the piston chamber to the low-pressure zone between the first and the second sealing edge, wherein d1>d2>d3, d1 are the minimum diameter of the first discharge throttle, d2 being the minimum diameter of the second discharge throttle, and d3 being the minimum diameter of the supply throttle.

19 Claims, 7 Drawing Sheets

U.S. PATENT DOCUMENTS

| | | | | |
|---|---|---|---|---|
| 6,168,132 | B1 | 1/2001 | Frank et al. | 251/33 |
| 6,250,563 | B1 | 6/2001 | Frank et al. | 239/88 |
| 6,293,254 | B1 * | 9/2001 | Crofts et al. | 123/467 |
| 6,367,453 | B1 * | 4/2002 | Igashira et al. | 123/467 |
| 6,484,698 | B2 * | 11/2002 | Boecking | 123/467 |
| 6,561,435 | B2 | 5/2003 | Kluegl | 239/88 |
| 6,663,014 | B1 * | 12/2003 | Depayva et al. | 239/88 |
| 6,928,986 | B2 * | 8/2005 | Niethammer et al. | 123/467 |
| 7,284,712 | B2 * | 10/2007 | Funai et al. | 239/533.1 |
| 7,347,385 | B2 | 3/2008 | Boecking | 239/96 |
| 7,651,039 | B2 * | 1/2010 | Suzuki | 239/533.8 |
| 7,874,502 | B2 * | 1/2011 | Harcombe et al. | 239/533.3 |
| 7,926,737 | B2 * | 4/2011 | Stoecklein et al. | 239/96 |
| 2003/0047619 | A1 * | 3/2003 | Boecking | 239/88 |
| 2004/0000597 | A1 * | 1/2004 | Depayva et al. | 239/88 |
| 2004/0035950 | A1 * | 2/2004 | Baranowski et al. | 239/88 |
| 2005/0173563 | A1 * | 8/2005 | Coldren et al. | 239/533.1 |
| 2007/0284455 | A1 * | 12/2007 | Suzuki | 239/96 |

FOREIGN PATENT DOCUMENTS

| | | | |
|---|---|---|---|
| DE | 10055644 | A1 | 5/2002 |
| DE | 10120157 | A1 | 11/2002 |
| DE | 10240442 | | 12/2003 |
| DE | 10326257 | | 1/2005 |
| DE | 10326260 | | 1/2005 |
| FR | 2897396 | | 8/2007 |
| WO | 9934111 | | 7/1999 |
| WO | 9961779 | | 12/1999 |
| WO | 2004048769 | | 6/2004 |

* cited by examiner

INJECTION SYSTEM, AND METHOD FOR THE PRODUCTION OF AN INJECTION SYSTEM

CROSS-REFERENCE TO RELATED APPLICATIONS

This application is a U.S. National Stage Application of International Application No. PCT/EP2008/060219 filed Aug. 4, 2008, which designates the United States of America, and claims priority to German Application No. 10 2007 042 466.5 filed Sep. 6, 2007, the contents of which are hereby incorporated by reference in their entirety.

TECHNICAL FIELD

The invention relates to an injection system for injecting fuel at a predetermined fuel pressure, the injection system having a high-pressure zone which is exposed to the fuel pressure and a low-pressure zone, and to a method for producing such an injection system.

BACKGROUND

The technical field of the invention relates to injection systems, in particular common-rail injection systems or common-rail injectors having hydraulic transmission. Due to the principles involved, actuation of the pilot valve of the hydraulic transmitter results in a switching leakage.

In this regard FIG. 1 shows a schematic view of a known injector I, with reference to which the switching leakage that occurs due to the principles involved and a conventional approach to a solution for reducing the occurrence of the switching leakage are discussed. The injector I depicted in FIG. 1 has a magnet actuator MA, a high-pressure connection HA for carrying pressurized fuel, a pilot valve SV and a nozzle D by means of which the fuel is injected. A control piston SK is arranged between a valve pin DN and the pilot valve SV which is actuated by means of the magnet actuator MA. When the pilot valve SV is opened by means of the magnet actuator MA, a pressure drop is produced in a control chamber SR containing the control piston SK. The pressure drop occurs in particular because a discharge throttle AD between the control chamber SR and a valve chamber VR containing the pilot valve SV is bigger than a supply throttle ZD which couples the high-pressure connection HA to the control chamber SR. For as long as the injection continues, fuel flows along a valve piston which couples the magnet actuator MA to the pilot valve SV, from a high-pressure zone of the injector I to a low-pressure zone of the injector I. This fuel outflow during the injection is referred to as switching leakage. The occurrence of switching leakage disadvantageously signifies the loss of energy, because compressed fuel flows into the low-pressure zone of the injector.

The injector depicted in FIG. 1 is disclosed e.g. in FIG. 4 of the publication titled "Der BMW Sechszylinder-Dieselmotor mit EU4-Technik" ("*The BMW six-cylinder diesel engine featuring EU4 technology*") by Dipl.-Ing. K. Mayer, Dipl.-Ing. W. Neuhäuser and Ing. F. Steinparzer, published at the 25th International Motor Symposium in Vienna, 2004.

As an approach for solving the problem of switching leakage, the control piston SK illustrated in FIG. 1 has a cone K which serves as a stop. When the fuel is injected, the control piston SK and its cone K, moving toward the magnet actuator MA, closes a channel which leads to the discharge throttle AD. Consequently, the pressure in the control chamber SR increases again at least to some extent. The pressure in the control chamber SR increases until it is greater than the pressure in a valve pin chamber DNR containing a valve pin DN. However, if the pressure in the control chamber SR is greater than that in the valve pin chamber DNR, the pilot valve SV opens again. This results in an oscillating motion of the control piston SK and therefore to a continuous opening and closing of the pilot valve SV. Therefore, although the switching leakage is somewhat reduced, the injection is choked due to the continuously repeated closure that is caused by the oscillating motion of the control piston SK and the valve pin DN which is coupled to the control piston SK. Furthermore, the oscillating motion of the valve pin is disadvantageously evident in the injection rate and in the injection jet.

An injector having hydraulic transmission is also disclosed in FIGS. 4 and 5 of the publication titled "A Common-Rail Injection System for High Speed Direct Injection Diesel Engines" by N. Guerrassi and P. Doparz, published in "Society of Automotive Engineers Inc. 1998". In this case it is proposed that the switching leakage be minimized by means of minimizing the control piston diameter to the minimum possible diameter, specifically to the diameter of the valve pin. This solution has slight advantages with regard to minimizing the switching leakage, but has disadvantages with regard to the switching speed and the dimensioning of the overall injector system.

SUMMARY

According to various embodiments, the switching leakage of an injection system can be reduced or minimized.

According to other embodiments, the switching leakage of an injection system can be reduced or minimized without reducing the diameter of the control piston.

According to an embodiment, an injection system for injecting fuel at a predetermined fuel pressure having a high-pressure zone which is exposed to the fuel pressure and a low-pressure zone may comprise: a controllable actuator that provides a working stroke for indirectly actuating a valve pin which opens and closes a nozzle in an opening direction or in a closing direction; a pilot valve which is arranged in a valve chamber of the high-pressure zone and which has a valve mushroom and opens or closes as a function of the working stroke that is provided; a supply throttle that is disposed between a high-pressure connection and a control chamber of the high-pressure zone in order to supply the fuel, said control chamber containing a control piston; a first discharge throttle located between the control chamber and the valve chamber; a first sealing edge of the valve chamber, said first sealing edge embodying a first sealing seat in conjunction with the valve mushroom when the nozzle is closed, in order to seal the piston chamber and the valve chamber from each other; a second sealing edge of a piston chamber that has a valve piston, said second sealing edge embodying a second sealing seat in conjunction with the valve piston during a maximum working stroke of the actuator, in order to at least substantially seal the piston chamber and the valve chamber from each other; and a second discharge throttle that connects the piston chamber to the low-pressure zone between the first and the second sealing edge; wherein d1>d2>d3, where d1 denotes the minimum diameter of the first discharge throttle, d2 denotes the minimum diameter of the second discharge throttle, and d3 denotes the minimum diameter of the supply throttle.

According to a further embodiment, d1>>d3. According to a further embodiment, the valve pin for opening and closing a nozzle by means of which the fuel is injected can be arranged in a nozzle chamber of the high-pressure zone.

According to a further embodiment, the high-pressure connection for supplying the fuel at the predetermined fuel pressure can be arranged in the high-pressure zone. According to a further embodiment, the control piston which is arranged in the control chamber of the high-pressure zone can be coupled to the valve pin and may be suitable for being moved in the opening direction when the pilot valve is opened and in the closing direction when the pilot valve is closed. According to a further embodiment, the valve piston which is arranged in the piston chamber may transmit the working stroke provided by the actuator to the valve mushroom of the pilot valve. According to a further embodiment, the actuator can be embodied as a piezoelectric actuator or as a magnet actuator. According to a further embodiment, the piezoelectric actuator may have a controllable piezoelectric stack which provides the working stroke for indirectly actuating the valve pin in the opening direction or in the closing direction as a function of a control signal. According to a further embodiment, by means of the valve piston, the piezoelectric actuator may be suitable for operating the first sealing seat in an open state and the second sealing seat in an open state during the injection process within a first time period, and for operating the first sealing seat in the open state and the second sealing seat in a closed state within a second time period following the first time period. According to a further embodiment, during the injection process the piezoelectric actuator can be adjusted to an intermediate stroke, at which the first sealing seat and the second sealing seat are each in the open state, and to the maximum working stroke, at which the first sealing seat is in the open state and the second sealing seat is in the closed state. According to a further embodiment, the piezoelectric actuator can be controlled such that it remains at the intermediate stroke and/or at the maximum working stroke for a predetermined time period in each case. According to a further embodiment, the piezoelectric actuator may be embodied such that its stroke speed can be adjusted as part of the injection process. According to a further embodiment, the piezoelectric actuator can be controlled such that the first time period and/or the second time period can be set to a relevant predeterminable time period. According to a further embodiment, the second discharge throttle may be embodied at least partly as a hole through a housing region. According to a further embodiment, the second discharge throttle may be embodied at least partly as a hole through the valve piston. According to a further embodiment, the second discharge throttle may be embodied at least partly as an outlet in the second sealing seat. According to a further embodiment, the valve piston may have at least one recess which at least partly forms the outlet at the maximum working stroke of the actuator. According to a further embodiment, the piston chamber may have at least one outlet region which at least partly embodies the outlet at the maximum working stroke of the actuator. According to a further embodiment, the injection system can be embodied as a common-rail injection system.

According to another embodiment, a method for the production of an injection system for injecting fuel at a predetermined fuel pressure, wherein the injection system comprises a high-pressure zone which is exposed to the fuel pressure and a low-pressure zone, may comprise the following steps of: providing a controllable actuator that provides a working stroke for indirectly actuating a valve pin which opens or closes a nozzle in an opening direction or a closing direction; arranging a pilot valve in a valve chamber of the high-pressure zone, wherein said pilot valve has a valve mushroom and opens or closes as a function of the working stroke that is provided; arranging a supply throttle between a high-pressure connection and a control chamber of the high-pressure zone in order to supply the fuel, said control chamber containing a control piston; arranging a first discharge throttle between the control chamber and the valve chamber; equipping the valve chamber with a first sealing edge, which embodies a first sealing seat in conjunction with the valve mushroom when the nozzle is closed, in order to seal the piston chamber and the valve chamber from each other; equipping a piston chamber which has a valve piston with a second sealing edge that embodies a second sealing seat in conjunction with the valve piston during a maximum working stroke of the actuator, in order to at least substantially seal the piston chamber and the valve chamber from each other; providing a second discharge throttle that connects the piston chamber between the first and the second sealing edge to the low-pressure zone; setting a ratio of $d1>d2>d3$, where d1 denotes the minimum diameter of the first discharge throttle, d2 denotes the minimum diameter of the second discharge throttle, and d3 denotes the minimum diameter of the supply throttle.

BRIEF DESCRIPTION OF THE DRAWINGS

The invention is explained in greater detail below with reference to the exemplary embodiments illustrated in the schematic figures, in which.

Unless expressly stated otherwise, identical or functionally identical elements and entities are labeled by the same reference signs in all of the figures.

DETAILED DESCRIPTION

Figure 1:
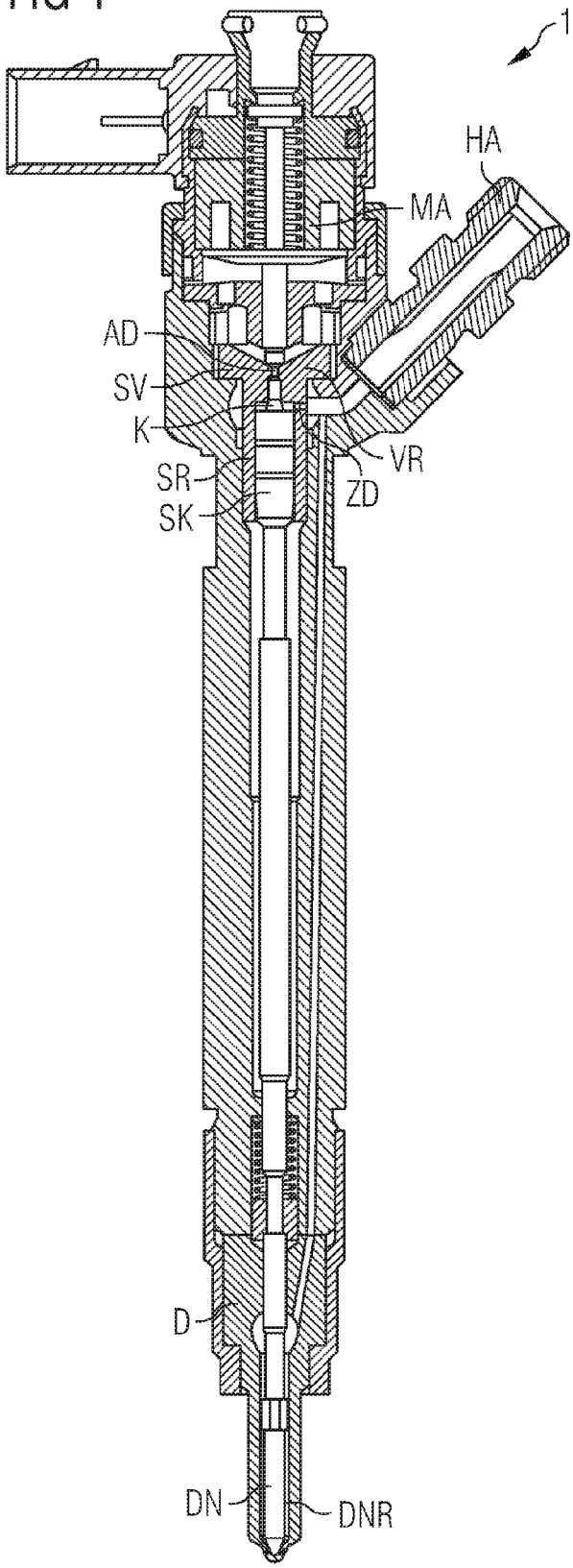
FIG. 1 shows a schematic view of a known injector.

Accordingly, an injection system for injecting fuel at a predetermined fuel pressure is proposed, wherein the system has a high-pressure zone which is exposed to the fuel pressure and a low-pressure zone and comprising:

a) a controllable actuator that provides a working stroke for indirectly actuating a valve pin which opens and closes a nozzle in an opening direction or a closing direction;

b) a pilot valve which is arranged in a valve chamber of the high-pressure zone and which has a valve mushroom and opens or closes as a function of the working stroke that is provided;

c) a supply throttle that is disposed between a high-pressure connection and a control chamber of the high-pressure zone in order to supply the fuel, said control chamber containing a control piston;

d) a first discharge throttle located between the control chamber and the valve chamber;

e) a first sealing edge of the valve chamber, said first sealing edge forming a first sealing seat in conjunction with the valve mushroom when the nozzle is closed, in order to seal the piston chamber and the valve chamber from each other;

f) a second sealing edge of a piston chamber containing a valve piston, said second sealing edge forming a second sealing seat in conjunction with the valve piston during a maximum working stroke of the actuator, in order to at least substantially seal the piston chamber and the valve chamber from each other;

g) a second discharge throttle that connects the piston chamber (6) between the first and the second sealing edge (16, 18) to the low-pressure zone (ND);

h) where d1>d2>d3, d1 being the minimum diameter of the first discharge throttle, d2 being the minimum diameter of the second discharge throttle, and d3 being the minimum diameter of the supply throttle.

Also proposed is a method for producing an injection system for injecting fuel at a predetermined fuel pressure, comprising a high-pressure zone which is exposed to the fuel pressure and a low-pressure zone, wherein said method has the following steps:

a) providing a controllable actuator that provides a working stroke for indirectly actuating a valve pin which opens or closes a nozzle in an opening direction or a closing direction;

b) arranging a pilot valve in a valve chamber of the high-pressure zone, wherein said pilot valve has a valve mushroom and opens or closes as a function of the working stroke that is provided;

c) arranging a supply throttle between a high-pressure connection and a control chamber of the high-pressure zone in order to supply the fuel, said control chamber containing a control piston;

d) arranging a first discharge throttle between the control chamber and the valve chamber;

e) equipping the valve chamber with a first sealing edge which embodies a first sealing seat in conjunction with the valve mushroom when the nozzle is closed, in order to seal the piston chamber and the valve chamber from each other;

f) equipping a piston chamber which has a valve piston with a second sealing edge that embodies a second sealing seat in conjunction with the valve piston during a maximum working stroke of the actuator, in order to at least substantially seal the piston chamber and the valve chamber from each other;

g) providing a second discharge throttle that connects the piston chamber (6) between the first and the second sealing edge (16, 18) to the low-pressure zone (ND);

h) setting a ratio of d1>d2>d3, where d1 denotes the minimum diameter of the first discharge throttle, d2 denotes the minimum diameter of the second discharge throttle, and d3 denotes the minimum diameter of the supply throttle.

According to various embodiment, the switching leakage of the injection system can be reduced or minimized. This is even possible with a diameter of the control piston that is larger or significantly larger than the diameter of the valve pin. This is achieved as follows: according to various embodiments of the injection system, the diameter d1 of the first discharge throttle is larger than the diameter d3 of the supply throttle. The diameter of the first discharge throttle in relation to the diameter of the supply throttle primarily influences the opening speed of the injection system or injector. This means that the larger the discharge throttle can be embodied relative to the supply throttle, the faster the pressure is reduced in the control chamber, whereupon the control piston moves upward in the control chamber. As a result of this, the valve pin is opened. In contrast to the present invention, however, if the first discharge throttle were embodied to be smaller relative to the supply throttle, the dead time until the valve pin begins to move would be too short for a plurality of injections in rapid succession. According to various embodiments, therefore, the first discharge throttle is large in its diameter relative to the diameter of the supply throttle, such that the injector or the injection system opens with less dead time. However, if the valve pin is fully open or, as the case may be, the control piston fully raised, it would only be necessary henceforth to have a discharge throttle which is only very slightly larger than the supply throttle. The discharge throttle would therefore only have to be large enough to prevent any buildup of pressure in the control chamber that is greater than the pressure in the valve pin chamber. Thus, as long as the discharge throttle is larger than the supply throttle, there will be no buildup in the control chamber of pressure which would move the control piston and hence the valve pin downward, thereby closing the nozzle. According to various embodiments a second discharge throttle is provided for that purpose between the low-pressure zone and the high-pressure zone, said second discharge throttle having a diameter d2 that is slightly larger than the diameter d3 of the supply throttle but is smaller than the diameter d1 of the first discharge.

Consequently, a reduced flow through the valve chamber from the high-pressure zone into the low-pressure zone is possible when the control piston is fully raised. In order to achieve this, a first step provides for the actuator to raise the valve piston just so far that the first sealing edge opens, i.e. the first sealing seat is in an open state and the large first discharge throttle can be fully effective. In addition, the second sealing seat is also open at this point in time. In a second step, when the control piston has reached its maximum stroke in the opening direction, i.e. it is fully raised, the second sealing seat is in a closed state and the first sealing seat is in an open state. Consequently, the pilot valve remains in an open state, there occurs no oscillating motion of control piston and valve pin, and the switching leakage is significantly reduced by the smaller diameter of the second discharge throttle relative to the first discharge throttle. The second discharge throttle is therefore manufactured such that it is only slightly larger than the supply throttle in terms of flow rate, thereby preventing the buildup in the control chamber of any pressure which is required to close the valve pin. As a result of this, the volume flow of the switching leakage is reduced to a value close to the flow rate of the supply throttle, i.e. that of the second discharge throttle. This results in reduced switching leakage, particularly for operating states in which the valve pin or nozzle is fully open. It is therefore possible to reduce the switching leakages in particular at points of maximum valve pin stroke according to various embodiments, i.e. precisely when the delivery volume of the injection system reaches its limits. A reduction in the switching leakage also results in an improved energy balance of the injection system and therefore results in reduced fuel consumption of a motor vehicle which is equipped with the injection system according to various embodiments.

Moreover it is possible by the provision of the second discharge throttle to make the first discharge throttle larger, thereby achieving significantly faster opening than is possible in the case of the known injectors.

According to an embodiment, the diameter d1 of the first discharge throttle is significantly larger than the diameter d3 of the supply throttle (d1>>d3). This embodiment is made possible in particular by the provision of the second discharge throttle, and has the advantage that faster opening of the nozzle is made possible thanks to the larger, first discharge throttle.

According to a further embodiment, the valve pin for opening and closing a nozzle by means of which the fuel is injected is arranged in a nozzle chamber of the high-pressure zone.

According to a further embodiment, the high-pressure connection for supplying the fuel at the predetermined fuel pressure is arranged in the high-pressure zone.

According to a further embodiment, the control piston which is arranged in the control chamber of the high-pressure zone is coupled to the valve pin and furthermore is suitable for being moved in the opening direction when the pilot valve is opened and in the closing direction when the pilot valve is closed.

According to a further embodiment, the valve piston which is arranged in a piston chamber transmits the working stroke provided by the actuator to the valve mushroom of the pilot valve.

According to a further embodiment, the actuator is embodied as a piezoelectric actuator or as a magnet actuator.

According to a further embodiment, the piezoelectric actuator has a controllable piezoelectric stack which provides a lift or working stroke for the purpose of indirectly actuating the valve pin in the closing direction or in the opening direction as a function of a control signal.

According to an embodiment, the piezoelectric actuator is suitable by means of the valve piston for operating the first sealing seat in an open state and the second sealing seat in an open state during the injection process within a first time period, and for operating the first sealing seat in the open state and the second sealing seat in a closed state within a second time period following the first time period. Advantageously, the first discharge throttle can be fully effective during the first time period, thereby allowing rapid opening of the nozzle. Furthermore, an increased pressure drop in the control chamber is no longer necessary in the second time period, because the nozzle is already open. The switching leakage can therefore be reduced in the second time period by means of the arrangement of the smaller, second discharge throttle.

According to a further preferred development, the piezoelectric actuator can be adjusted at least to an intermediate stroke and to the maximum working stroke during the injection process. At the intermediate stroke, the first sealing seat is in the open state and the second sealing seat is likewise in the open state. At the maximum working stroke, however, the second sealing seat is in the closed state while the first sealing seat is in the open state.

According to a further preferred development, the piezoelectric actuator can be controlled such that it remains at the intermediate stroke and/or at the maximum working stroke for a predeterminable time period in each case. It is therefore advantageously possible indirectly to adjust the first time period for the opening of the nozzle and the second time period for the injection process when the nozzle is open.

According to a further preferred development, the piezoelectric actuator is embodied such that its stroke speed can be adjusted during the injection process. This provides an alternative to a piezoelectric actuator that can be adjusted to an intermediate stroke, wherein the first time period and the second time period can be mapped using said alternative.

According to a further embodiment, the piezoelectric actuator can be controlled such that the first time period and/or the second time period can be adjusted to a relevant predeterminable time period. It is therefore advantageously possible to adjust the first time period and the second time period directly.

According to a further embodiment, the second discharge throttle is embodied at least partly as a hole through a housing region of the injection system.

According to a further embodiment, the second discharge throttle is embodied at least partly as a hole through the valve piston.

According to a further embodiment, the second discharge throttle is embodied at least partly as an outlet in the second sealing seat. In this case, the valve piston can be provided with a recess which at least partly forms the outlet at the maximum working stroke of the actuator. Alternatively or additionally, the piston chamber can have at least one outlet region which at least partly forms the outlet at the maximum working stroke of the actuator.

Figure 2:
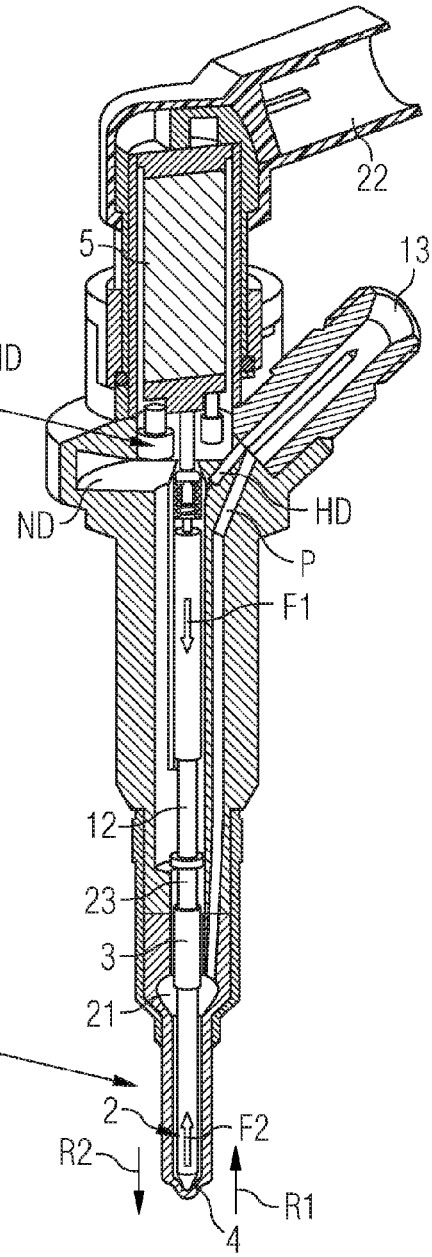
FIG. 2 shows a schematic longitudinal sectional view of an exemplary embodiment of an injection system in a first operating state.
Figure 2A:
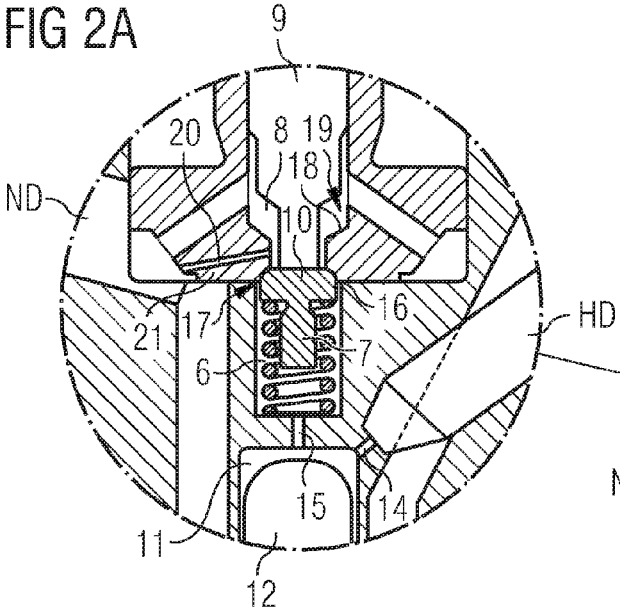
FIG. 2*a* shows a schematic partial view of an upper region of the injection system according to FIG. 2.
Figure 3A:
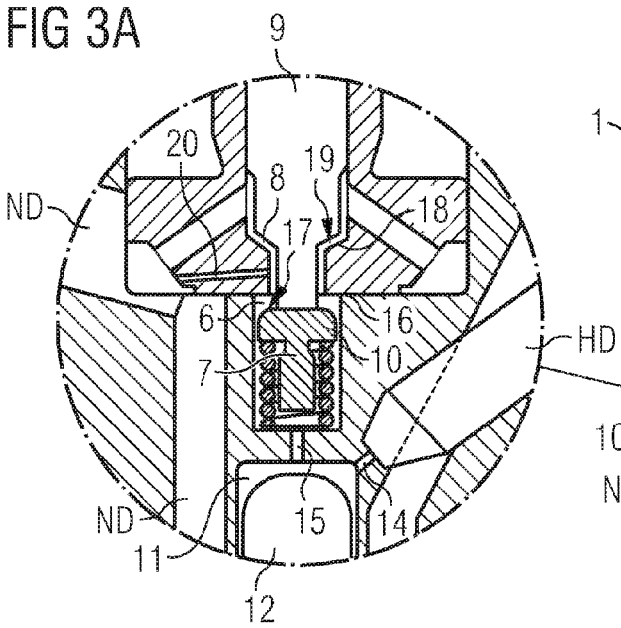
FIG. 3*a* shows a schematic detailed view of an upper region of the injection system according to FIG. 3.
Figure 3:
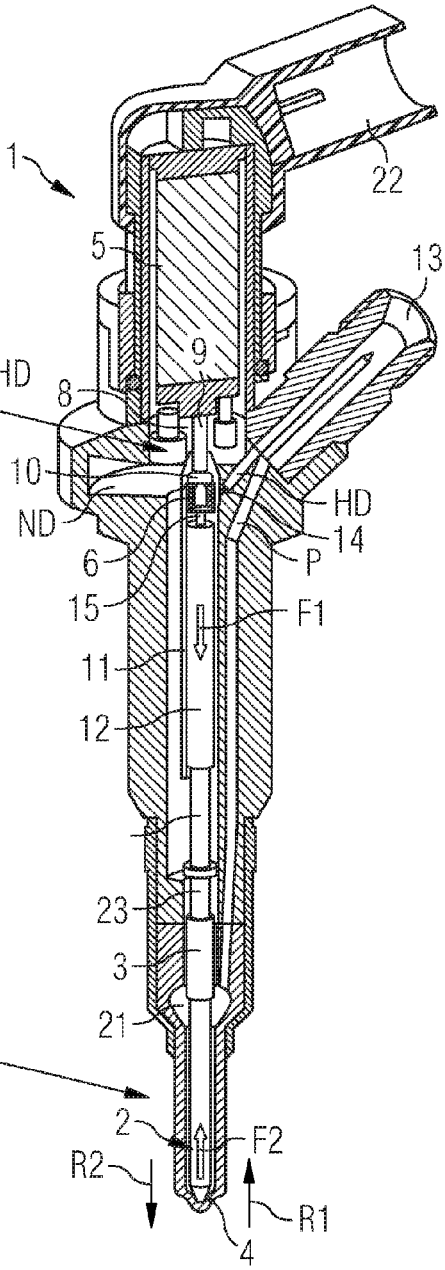
FIG. 3 shows a schematic longitudinal sectional view of the exemplary embodiment of the injection system in a second operating state.

FIGS. 2 and 3 with their respective detailed views 2*a*, 2*b* and 3*a*, 3*b* show an exemplary embodiment of the injection system 1 or injector for injecting fuel at a predetermined fuel pressure P, comprising a high-pressure zone HD which is exposed to the fuel pressure P and a low-pressure zone ND.

The injection system 1 has a controllable actuator 5, a pilot valve 7 which is arranged in a valve chamber 6 of the high-pressure zone HD, a supply throttle 14, a first discharge throttle 15, a first sealing edge 16 of the valve chamber 6, a second sealing edge 18 of a piston chamber 8 having a valve piston 9, and a second discharge throttle 20.

FIG. 2 and the associated detailed views 2*a* and 2*b* show the injection system 1 in a first operating state. The first operating state is characterized by a first sealing seat 17 being in a closed state and a second sealing seat 19 in an open state. Consequently, the pilot valve 7 is in a closed state and the valve pin 3 closes the nozzle 4. By contrast, FIG. 3 and the associated detailed views 3*a* and 3*b* show the injection system 1 in a second operating state. The second operating state is characterized by the first sealing seat 17 being in the open state and the second sealing seat 19 being in an open state.

The controllable actuator 5 provides a working stroke for indirectly actuating the valve pin 3 which opens or closes the nozzle 4 in an opening direction R1 or a closing direction R2.

Figure 2B:
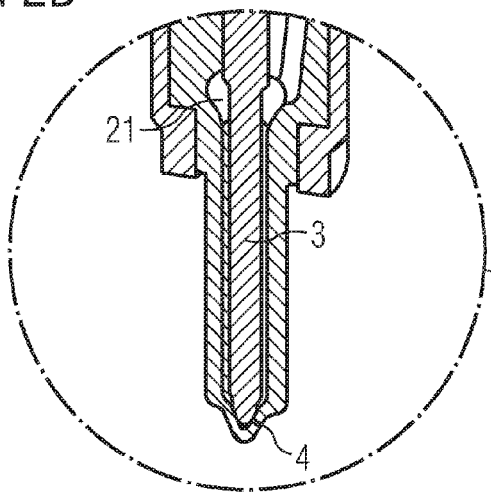
FIG. 2*b* shows a schematic detailed view of a lower region of the injection system according to FIG. 2.
Figure 3B:
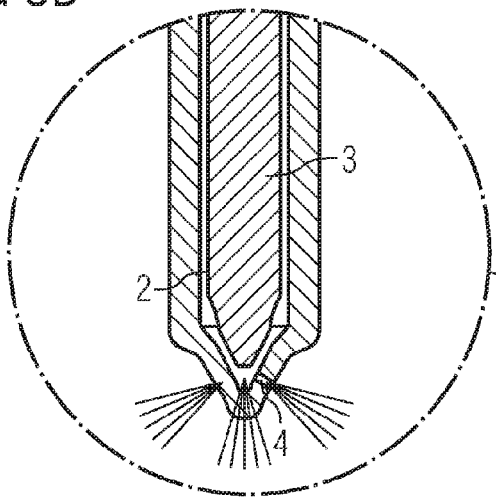
FIG. 3*b* shows a schematic partial view of a lower region of the injection system according to FIG. 3.

In this case FIG. 2*b* shows a closed nozzle 4 and FIG. 3*b* shows an open nozzle 4 through which the fuel is injected.

The pilot valve 7 has at least one valve mushroom 10 and opens as a function of the working stroke that is provided by the actuator 5.

The supply throttle 14 for supplying the fuel P is arranged between a high-pressure connection 13 and a control chamber 11 of the high-pressure zone HD, wherein said control chamber 11 has a control piston 12.

In particular, the valve pin 3 for opening and closing the nozzle 4 in which the fuel P is injected is arranged in a nozzle chamber 2 of the high-pressure zone. The high-pressure connection 13 is likewise arranged in the high-pressure zone HD. The high-pressure connection 13 is suitable for supplying the fuel at the predetermined fuel pressure P.

The first discharge throttle 15 is arranged between the control chamber 11 and the valve chamber 6. The first sealing edge 16 of the valve chamber 6 embodies a first sealing seat 17 in conjunction with the valve mushroom 10 of the pilot valve 7 (e.g. a servo valve) when the nozzle 4 is closed, in order to seal the piston chamber 8 and the valve chamber 6 from each other.

The second sealing edge 18 of the piston chamber 8 embodies a second sealing seat 19 in conjunction with the valve piston 9 during a maximum working stroke of the actuator 5, in order to seal the piston chamber 8 and the valve chamber 6 from each other.

The minimum diameter d1 of the first discharge throttle 15 is embodied in such a way that it is larger than the minimum diameter d2 of the second discharge throttle 20 and larger than the minimum diameter d3 of the supply throttle 14. Furthermore, the diameter d2 of the second discharge throttle 20 is embodied in such a way that it is larger than the diameter 3 of the supply throttle 14. Overall it therefore holds that d1>d2>d3. Furthermore it preferably holds that d1>>d3. According to the embodiment shown in FIG. 3*a*, the second discharge throttle 20 is embodied as a hole through a housing region 21 of the injection system 1.

The control piston 12 which is arranged in the control chamber 11 of the high-pressure zone HD is coupled to the valve pin 3, in particular by means of a stroke adjustment bolt 23. Furthermore, the control piston 12 is preferably suitable for being moved in the opening direction R1 when the pilot valve 7 opens and in the closing direction R2 when the pilot valve 7 closes. Furthermore, a high-pressure chamber 21 is preferably provided in the nozzle chamber 2 so as to provide a reservoir of fuel at the predetermined fuel pressure P for lifting the valve pin 3.

The valve piston 9 which is arranged in the piston chamber 8 preferably transmits the working stroke that is provided by the actuator 5 to the valve mushroom 10 of the pilot valve 7. The actuator 5 is embodied for example as a magnet actuator or preferably as a piezoelectric actuator. The embodiment of the actuator as a piezoelectric actuator 5 preferably has a controllable piezoelectric stack which provides a lift or working stroke for indirectly actuating the valve pin 3 in the opening direction R1 or in the closing direction R2 as a function of a control signal. In the exemplary embodiment of the injection system 1 according to FIGS. 2 and 3, a piezoelectric actuator 5 is shown in each case. The piezoelectric actuator 5 is preferably coupled to a contact device 22 by means of which the control signal can be transmitted to the external electrodes of the piezoelectric actuator 5.

The piezoelectric actuator 5 is preferably suitable by means of the valve piston 9 for operating the first sealing seat 17 in an open state and the second sealing seat 19 in an open state during the injection process within a first time period (see FIG. 3*a* in particular), and for operating the first sealing seat 17 in the open state and the second sealing seat 19 in a closed state (not shown) within a second time period following the first time period. In order to achieve this, the piezoelectric actuator 5 can be adjusted, in particular during the injection process, to an intermediate stroke at which the first sealing seat 17 and the second sealing seat 19 are in the open state in each case (see FIG. 3*a* in particular). Moreover, the piezoelectric actuator 5 can be adjusted during the injection process to the maximum working stroke at which the first sealing seat 17 is in the open state and the second sealing seat 19 is in the closed state (not shown).

Furthermore, the piezoelectric actuator 5 can be controlled such that it remains at the intermediate stroke and/or at the maximum working stroke for a predeterminable time period in each case.

The piezoelectric actuator 5 can also be embodied such that its stroke speed can be adjusted in the course of the injection process. Furthermore, the piezoelectric actuator 5 can be controlled such that the first time period and/or the second time period can be adjusted to a specific time duration.

Figure 4:
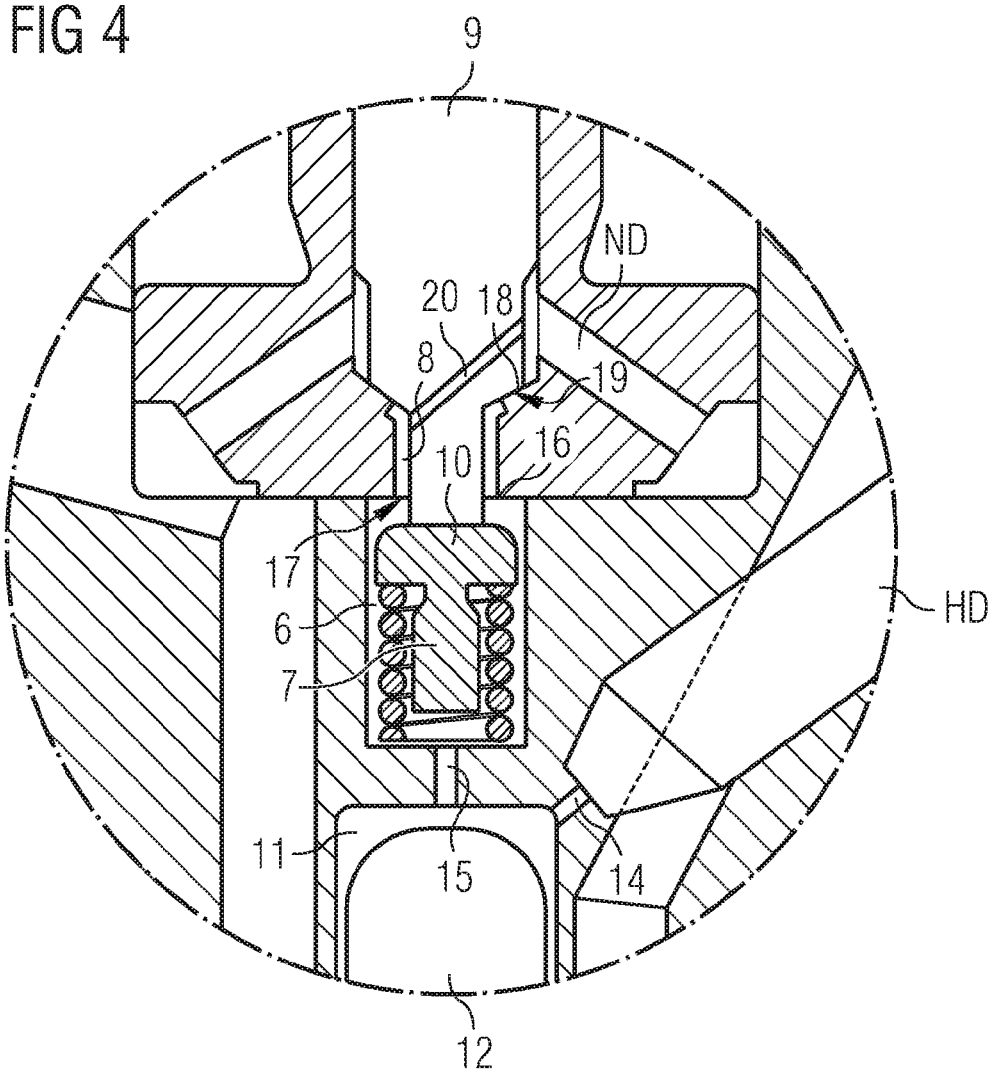
FIG. 4 shows a schematic detailed view of a first alternative to the embodiment of the upper region of the injection system according to FIG. 3*a;*
Figure 5:
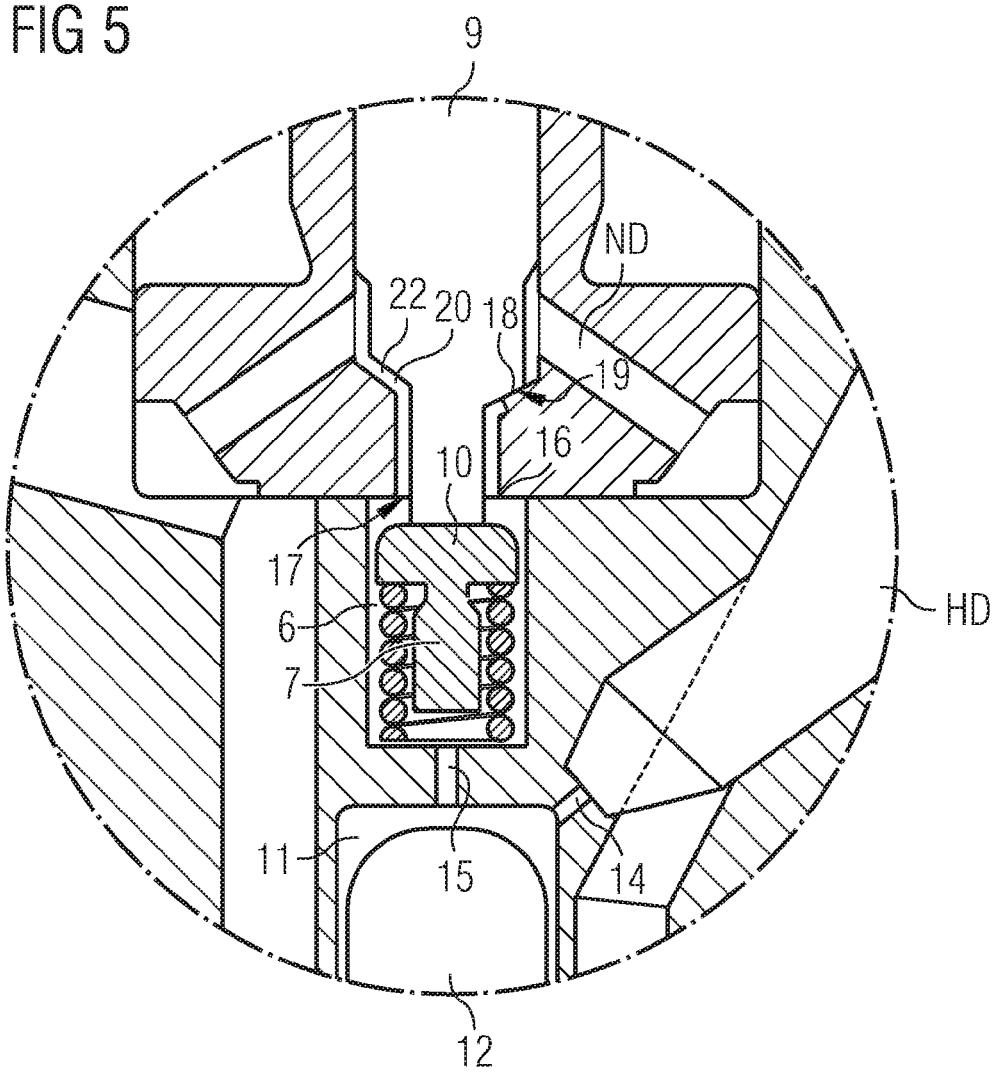
FIG. 5 shows a schematic detailed view of a second alternative to the embodiment of the upper region of the injection system according to FIG. 3.
Figure 6:
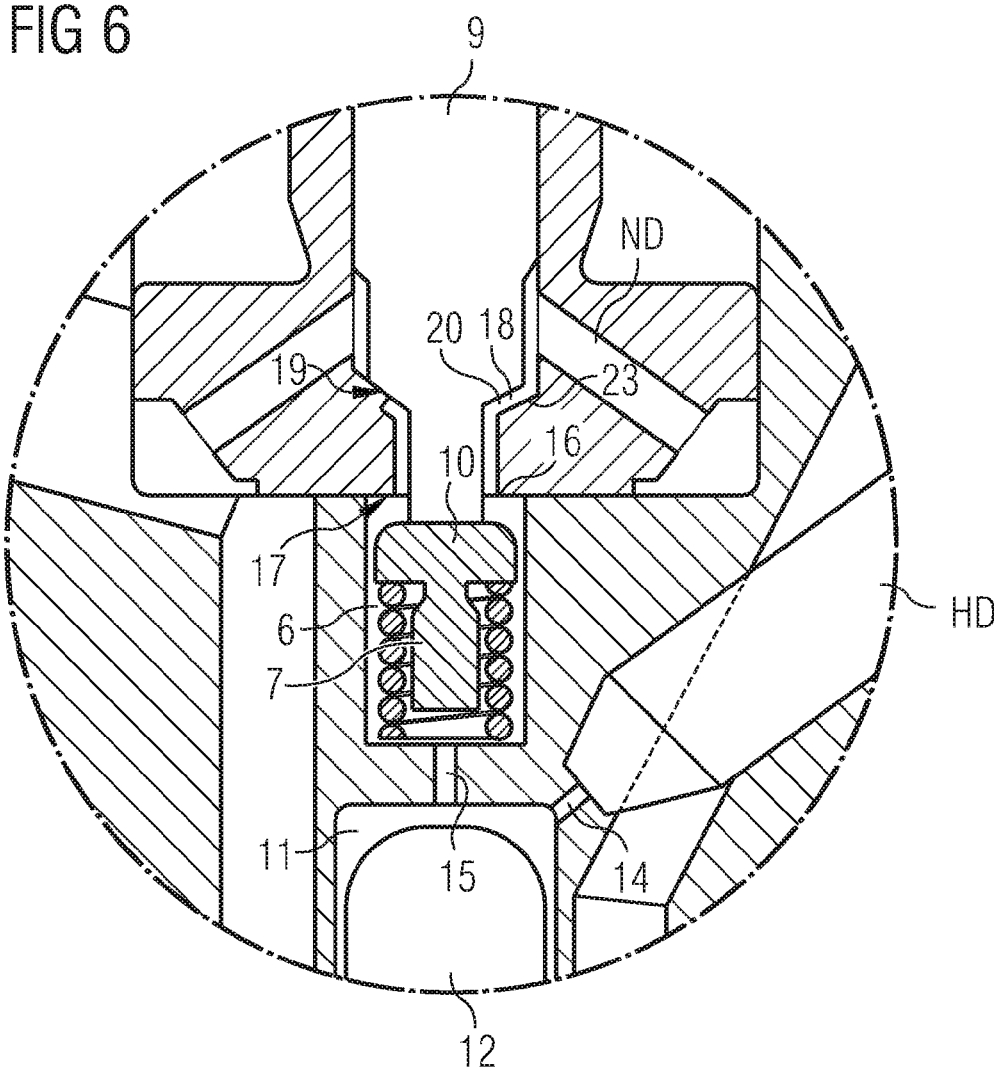
FIG. 6 shows a schematic detailed view of a third alternative to the embodiment of the upper region of the injection system according to FIG. 3*a*.

FIGS. 4 to 6 show three alternatives to the embodiment of the upper region of the injection system 1 according to FIG. 3*a*. These alternatives relate in particular to the embodiment of the second discharge throttle 20.

According to FIG. 4, the second discharge throttle is embodied as a hole through the valve piston 9.

According to FIGS. 5 and 6, the second discharge throttle 20 is embodied as an outlet 22, 23 in the second sealing seat 19. In this case the valve piston 9 according to FIG. 5 has at least one recess 22 which forms the outlet at the maximum working stroke of the actuator 5. By contrast, the piston chamber 8 according to FIG. 6 has at least one outlet region 23 which forms the outlet at the maximum working stroke of the actuator 5.

Figure 7:
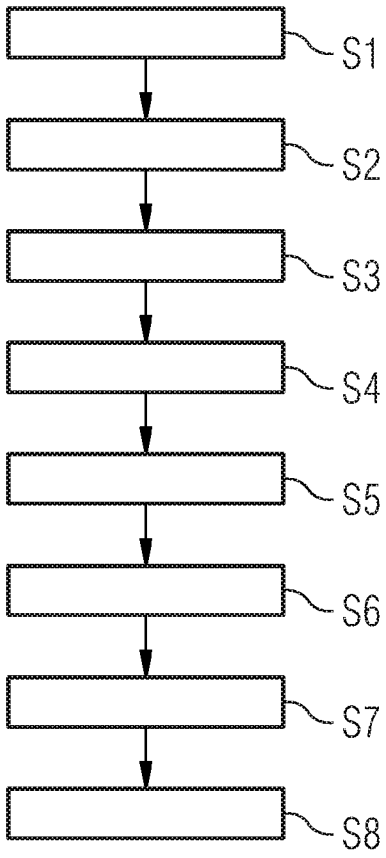
FIG. 7 shows a schematic flow diagram of a method for the production of an injection system according to various embodiments.

FIG. 7 shows a schematic flow diagram of an exemplary embodiment of the method for the production of an injection system 1 for injecting fuel at a predetermined fuel pressure P, comprising a high-pressure zone HD which is exposed to the fuel pressure and a low-pressure zone ND. The method according to various embodiments is explained below with the aid of the block diagram in FIG. 7 and with reference to the various illustrations of the injection system 1 according to FIGS. 2, 2*a*, 2*b*, 3, 3*a* and 3*b*. The method according to various embodiments has the following method steps S1 to S8:

Method Step S1:

A controllable actuator 5 is provided which provides a working stroke for indirectly actuating a valve pin 3 in an opening direction R1 or in a closing direction R2, thereby opening or closing a nozzle 4.

Method Step S2:

A pilot valve 7 is arranged in a valve chamber 6 of the high-pressure zone HD and has a valve mushroom 10 and opens or closes as a function of the working stroke that is provided.

Method Step S3:

A supply throttle 14 is arranged between a high-pressure connection 13 and a control chamber 11 of the high-pressure zone HD for the purpose of supplying the fuel, said control chamber 11 having a control piston 12.

Method Step S4:

A first discharge throttle 15 is arranged between the control chamber 11 and the valve chamber 6.

Method Step S5:

The valve chamber 6 is equipped with a first sealing edge 16 which embodies a first sealing seat 17 in conjunction with the valve mushroom 10 when the nozzle 4 is closed, in order to seal the piston chamber 8 and the valve chamber 6 from each other.

Method Step S6:

A piston chamber 8 which has a valve piston 9 is equipped with a second sealing edge 18. The second sealing edge 18 embodies a second sealing seat 19 in conjunction with the valve piston 9 during a maximum working stroke of the actuator 5, in order to seal the piston chamber 8 and the valve chamber 6 from each other.

Method Step S7:

A second discharge throttle 20 is provided which is preferably embodied as a hole between the low-pressure zone ND and a region between the first and second sealing edge 16, 18.

Method Step S8:

A ratio between a diameter d1 of the first discharge throttle 15, a diameter d2 of the second discharge throttle 20 and a diameter d3 of the supply throttle 14 is set as follows: d1>d2>d3.

Although the present invention is described above with reference to the preferred exemplary embodiments, it is not restricted to these but can be modified in many different ways. It is conceivable, for example, to combine the described embodiments of the second discharge throttle, specifically the hole through the housing region, the hole through the valve piston, the recess in the valve piston and the outlet region of the piston chamber, provided that the resulting minimum overall diameter of the combination is larger than the minimum diameter of the supply throttle and smaller than the minimum diameter of the first discharge throttle.

What is claimed is:

1. An injection system for injecting fuel at a predetermined fuel pressure, said injection system having a high-pressure zone which is exposed to the fuel pressure and a low-pressure zone, and comprising:

a) a controllable actuator that provides a working stroke for indirectly actuating a valve pin which opens and closes a nozzle in an opening direction or in a closing direction;

b) a pilot valve which is arranged in a valve chamber of the high-pressure zone and which has a valve mushroom and opens or closes as a function of the working stroke that is provided;

c) a supply throttle that is disposed between a high-pressure connection and a control chamber of the high-pressure zone in order to supply the fuel, said control chamber containing a control piston;

d) a first discharge throttle located between the control chamber and the valve chamber;

e) a first sealing edge of the valve chamber, said first sealing edge embodying a first sealing seat in conjunction with the valve mushroom when the nozzle is closed, in order to seal the piston chamber and the valve chamber from each other;

f) a second sealing edge of a piston chamber that has a valve piston, said second sealing edge embodying a second sealing seat in conjunction with the valve piston during a maximum working stroke of the actuator, in order to at least substantially seal the piston chamber and the valve chamber from each other;

g) a second discharge throttle that connects the piston chamber to the low-pressure zone between the first and the second sealing edge;

h) wherein d1>d2>d3, where d1 denotes the minimum diameter of the first discharge throttle, d2 denotes the minimum diameter of the second discharge throttle, and d3 denotes the minimum diameter of the supply throttle.

2. The injection system according to claim 1, wherein the valve pin for opening and closing a nozzle by means of which the fuel is injected is arranged in a nozzle chamber of the high-pressure zone.

3. The injection system according to claim 1, wherein the high-pressure connection for supplying the fuel at the predetermined fuel pressure is arranged in the high-pressure zone.

4. The injection system according to claim 1, wherein the control piston which is arranged in the control chamber of the high-pressure zone is coupled to the valve pin and is suitable for being moved in the opening direction when the pilot valve is opened and in the closing direction when the pilot valve is closed.

5. The injection system according to claim 1, wherein the valve piston which is arranged in the piston chamber transmits the working stroke provided by the actuator to the valve mushroom of the pilot valve.

6. The injection system according to claim 1, wherein the actuator is embodied as a piezoelectric actuator or as a magnet actuator.

7. The injection system according to claim 1, wherein the piezoelectric actuator has a controllable piezoelectric stack which provides the working stroke for indirectly actuating the valve pin in the opening direction or in the closing direction as a function of a control signal.

8. The injection system according to claim 1, wherein by means of the valve piston, the piezoelectric actuator is suitable for operating the first sealing seat in an open state and the second sealing seat in an open state during the injection process within a first time period, and for operating the first sealing seat in the open state and the second sealing seat in a closed state within a second time period following the first time period.

9. The injection system according to claim 8, wherein during the injection process the piezoelectric actuator can be adjusted to an intermediate stroke, at which the first sealing seat and the second sealing seat are each in the open state, and to the maximum working stroke, at which the first sealing seat is in the open state and the second sealing seat is in the closed state.

10. The injection system according to claim 9, wherein the piezoelectric actuator can be controlled such that it remains at the intermediate stroke and/or at the maximum working stroke for a predetermined time period in each case.

11. The injection system according to claim 8, wherein the piezoelectric actuator is embodied such that its stroke speed can be adjusted as part of the injection process.

12. The injection system according to claim 8, wherein the piezoelectric actuator can be controlled such that at least one of the first time period and the second time period can be set to a relevant predeterminable time period.

13. The injection system according to claim 1, wherein the second discharge throttle is embodied at least partly as a hole through a housing region.

14. The injection system according to claim 1, wherein the second discharge throttle is embodied at least partly as a hole through the valve piston.

15. The injection system according to claim 1, wherein the second discharge throttle is embodied at least partly as an outlet in the second sealing seat.

16. The injection system according to claim 15, wherein the valve piston has at least one recess which at least partly forms the outlet at the maximum working stroke of the actuator.

17. The injection system according to claim 15, wherein the piston chamber has at least one outlet region which at least partly embodies the outlet at the maximum working stroke of the actuator.

18. The injection system according to claim 1, wherein the injection system is embodied as a common-rail injection system.

19. A method for the production of an injection system for injecting fuel at a predetermined fuel pressure, said injection system comprising a high-pressure zone which is exposed to the fuel pressure and a low-pressure zone, said method comprising the following steps of:

a) providing a controllable actuator that provides a working stroke for indirectly actuating a valve pin which opens or closes a nozzle in an opening direction or a closing direction;

b) arranging a pilot valve in a valve chamber of the high-pressure zone, wherein said pilot valve has a valve mushroom and opens or closes as a function of the working stroke that is provided;

c) arranging a supply throttle between a high-pressure connection and a control chamber of the high-pressure zone in order to supply the fuel, said control chamber containing a control piston;

d) arranging a first discharge throttle between the control chamber and the valve chamber;

e) equipping the valve chamber with a first sealing edge, which embodies a first sealing seat in conjunction with the valve mushroom when the nozzle is closed, in order to seal the piston chamber and the valve chamber from each other;

f) equipping a piston chamber which has a valve piston with a second sealing edge that embodies a second sealing seat in conjunction with the valve piston during a maximum working stroke of the actuator, in order to at least substantially seal the piston chamber and the valve chamber from each other;

g) providing a second discharge throttle that connects the piston chamber between the first and the second sealing edge to the low-pressure zone;

h) setting a ratio of $d1>d2>d3$, where $d1$ denotes the minimum diameter of the first discharge throttle, $d2$ denotes the minimum diameter of the second discharge throttle, and $d3$ denotes the minimum diameter of the supply throttle.

* * * * *